US005255523A

United States Patent [19]

Burgers et al.

[11] Patent Number: 5,255,523

[45] Date of Patent: Oct. 26, 1993

[54] METHOD AND APPARATUS FOR DETERMINING THE SOLID FRACTION OF A STORED CRYOGENIC REFRIGERATION SYSTEM

[75] Inventors: Kenneth L. Burgers, Woodridge; Arif Y. Kiziltug, Naperville; Royce J. Laverman, South Holland; William S. Schoerner, Plainfield, all of Ill.

[73] Assignee: Liquid Carbonic Corporation, Oak Brook, Ill.

[21] Appl. No.: 949,426

[22] Filed: Sep. 22, 1992

[51] Int. Cl.[5] ..... F25J 5/00

[52] U.S. Cl. ..... 62/12; 62/37; 62/54.1; 62/384

[58] Field of Search ..... 62/10, 12, 54.1, 54.2, 62/384, 37

[56] References Cited

U.S. PATENT DOCUMENTS

| | | | |
|---|---|---|---|
| 4,127,008 | 11/1978 | Tyree, Jr. | 62/54.2 |
| 4,751,822 | 6/1988 | Viard | 62/384 |
| 5,139,548 | 8/1992 | Liu et al. | 62/37 |
| 5,161,381 | 11/1992 | Victor et al. | 62/37 |

*Primary Examiner*—Ronald C. Capossela
*Attorney, Agent, or Firm*—Fitch, Even, Tabin & Flannery

[57] ABSTRACT

In the method of the invention, an unknown mass fraction (F) of solid cryogen in a stored cryogenic refrigeration system is determined. The method includes the steps of adding mass (T) of a trace substance which is soluble in the liquid phase of the system. The total mass amount (M) of the cryogen in the system is determined at the time of charging the system. The initial mass concentration ($C_I$) of the trace substance is determined by dividing (T) by (M). During operation of the stored cryogenic refrigeration system, a small sample of the liquid phase cryogen is extracted from the system. The sample is analyzed to determine the new concentration ($C_N$) of the trace substance in the sample. The new concentration ($C_N$) of the sample is dependent on the amount of solid cryogen which has been produced in the system. Thereafter, the mass fraction (F) of solid cryogen in the system is determined by solving the equation:

$$F=1-(C_I/C_N)$$

14 Claims, 1 Drawing Sheet

METHOD AND APPARATUS FOR DETERMINING THE SOLID FRACTION OF A STORED CRYOGENIC REFRIGERATION SYSTEM

FIELD OF THE INVENTION

The present invention relates generally to a method and apparatus for determining the solids content in a stored cryogenic refrigeration system. More particularly, the present invention relates to a method for determining the solids content in a stored cryogenic refrigeration system utilizing a trace substance which is soluble in the liquid phase of the system.

BACKGROUND OF THE INVENTION

Stored cryogenic refrigeration systems are well known in the refrigeration industry. In general, these systems involve the use of a relatively large amount of refrigeration at cryogenic temperatures which is supplied on an intermittent basis by establishing a low temperature coolant reservoir of solid cryogen which can be economically created during a time period when there is low usage or the cost of electricity is lower. Buildup of refrigeration capacity in the reservoir can be accomplished relatively slowly, requiring fairly low power demands and relatively small capacity equipment. When the need for refrigeration arises, cold liquid cryogen is supplied at the necessary rate while taking advantage of the immediate availability of the capacity of the low temperature solid cryogen reservoir to remove the absorbed heat from a fluid stream returning to the reservoir. Such stored cryogenic refrigeration systems are described in U.S. Pat. No. 4,224,801 and 4,127,008, both to Tyree, Jr.

As indicated, stored cryogenic systems involve the use of mixtures of liquid and solid cryogen. The system generally consists of an insulated storage vessel containing a quantity of liquid cryogen, a gas compressor, and a liquid condenser. By using this equipment in a closed cycle, mechanical refrigeration can be stored by the production and accumulation of solid cryogen in the storage vessel. This stored refrigeration is recovered by recirculating liquid cryogen from the storage vessel through an external thermal load by means of a heat exchanger. The heated liquid cryogen and any gases produced are returned to the storage vessel and cause the solid cryogen to melt. This concept of energy storage relies on the heat of fusion which is the amount of heat required to change a quantity of solid to its liquid phase.

In such liquid-solid cryogen storage systems, it is highly desirable to be able to measure, on an intermittent or continuous basis, the solid fraction of the mixture which is a direct indication of the amount of stored refrigeration available. It is difficult to accurately determine the solid fraction of the mixture by visual techniques or by using floats or sonar, since a reliable solid to liquid interface is seldom achieved. Methods that require monitoring or analysis of solids content by doppler or density techniques are generally unsuitable since these techniques require a high degree of mixing and homogeneity of the vessel's contents.

The present invention provides a simple and reliable method and apparatus which can be used to determine the fraction of solids in a slurry or mixture of liquid and solid cryogen in a closed cycle incorporating a storage vessel.

SUMMARY OF THE INVENTION

Figure 1:
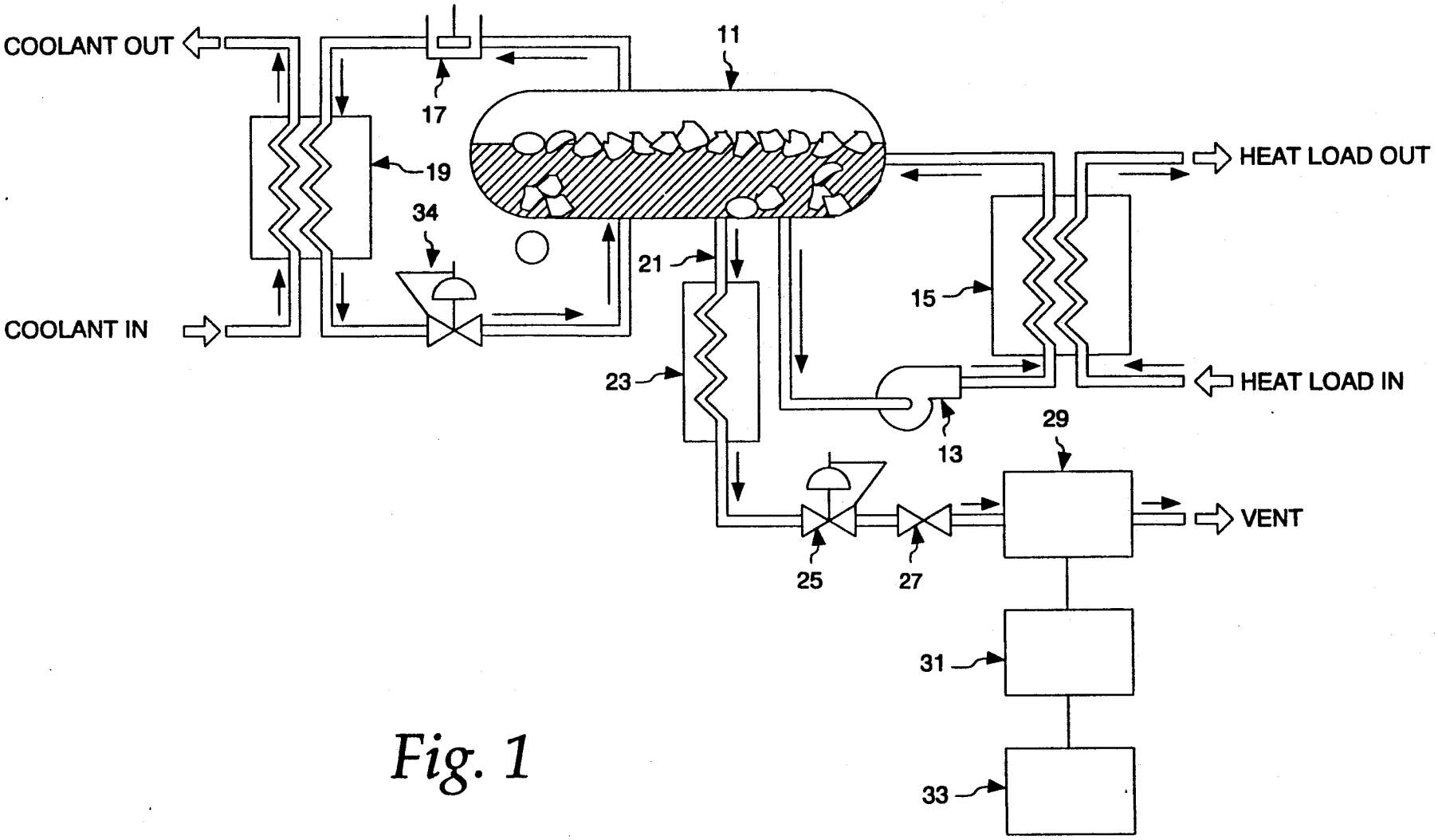
FIG. 1 is a schematic flow diagram of a stored cryogenic refrigeration system utilizing the apparatus of the invention for determining the mass fraction (F) of solid cryogen in the stored cryogenic refrigeration system.

In the method of the invention, an unknown mass fraction (F) of solid cryogen in a stored cryogenic refrigeration system is determined. The method includes the steps of adding a mass (T) of trace substance which is soluble in the liquid phase of the storage system. The total mass (M) of cryogen in the storage system is determined at the time of charging the storage system. The initial mass concentration ($C_I$) of the trace substance in the liquid phase cryogen prior to the production of any solid phase cryogen is determined by dividing (T) by (M) or by analyzing a sample of liquid phase cryogen from the storage system. During operation of the stored cryogenic refrigeration system, a small sample of the liquid phase cryogen is extracted from the storage system. This sample is heated to a temperature sufficient to vaporize the sample. The vaporized sample is analyzed to determine the new mass concentration ($C_N$) of the trace substance in the liquid phase cryogen of the storage system. The new mass concentration ($C_N$) is dependent on the mass (S) of solid cryogen in the system. The mass fraction (F) of solid cryogen in the storage system is determined by solving the equation:

$$F=1-(C_I/C_N)$$

The apparatus of the invention for determining the mass fraction (F) of solid cryogen in a stored cryogenic refrigeration system includes means for extracting a sample of liquid phase cryogen. Means are provided for vaporizing the liquid sample to provide a vapor sample for analysis. Means are provided for analyzing the vapor sample to generate a signal representing the mass concentration of a trace substance in the sample. Processing means are provided to determine the mass fraction (F) of the solid cryogen in the storage system by processing the signal to solve the equation:

$$F=1-(C_I/C_N)$$

wherein:

F = mass fraction of solid cryogen in the storage system, $C_I$ = initial mass concentration of the trace substance in the liquid phase cryogen of the storage system prior to the production of solid phase cryogen, and $C_N$ = new mass concentration of the trace substance of the liquid phase cryogen of the storage system after the production of a quantity of solid phase cryogen.

DETAILED DESCRIPTION OF THE INVENTION

The method of the present invention involves the addition of a trace substance to the storage vessel of a stored cryogenic refrigeration system. The trace substance is selected so as to be soluble in the liquid phase cryogen contents of the storage vessel. Any suitable cryogen can be used. For use of the stored cryogenic refrigeration system in food freezing applications, it is preferred to use cryogens which have a triple point between 0° F. and −100° F. For these applications, a particularly preferred cryogen is carbon dioxide.

The trace substance is selected so as to have properties such that it will not crystallize or precipitate from solution in the liquid phase cryogen within the normal operating temperature range of the stored cryogenic refrigeration system. The trace substance should not produce any chemical reactions or produce any new compounds when mixed with the cryogen. The amount of the trace substance dissolved in the cryogen is not critical so long as the concentration can be readily determined by an appropriate detection device or analyzer. In general, amounts of the trace substance from about 10 to about 1000 parts per million by weight are sufficient to practice the present invention to determine the mass fraction (F) of solid cryogen in a stored cryogenic refrigeration system. The trace substance preferably should have a vaporization temperature less than about 200° F. so as to be readily vaporizable at the time of analyzing a sample. The trace substance can be a salt, an acid, an organometallic compound or an organic compound. Examples of suitable trace substances that may be used with carbon dioxide cryogen include inorganic compounds such as stannis chloride and titanium tetrachloride and organic compounds such as trichloracetic acid, propane, propylene, normal butane, isobutane, butylene, normal pentane, isopentane, neopentane, cyclopentane and normal hexane.

The present invention is based on the principle that the concentration of the trace substance in the liquid cryogen will increase as liquid phase cryogen is converted to solid phase cryogen during normal operation of the stored cryogenic refrigeration system. This result follows from the fact that the solid phase cryogen that is formed consists of pure cryogen crystals and that the trace substance remains in the liquid phase and is not crystallized or precipitated from the liquid phase solution at the operating temperature of the stored cryogenic refrigeration system. As solid cryogen is produced, the concentration of the trace substance in the remaining liquid phase cryogen is increased.

As shown in FIG. 1, the stored cryogenic refrigeration system of the present invention includes a storage vessel 11 for containing liquid, gaseous and solid cryogen. During operation of the stored cryogenic refrigeration system when the system is providing refrigeration to a heat load, circulation pump 13 pumps a liquid cryogen stream from storage vessel 11 through heat exchanger 15, wherein the liquid cryogen stream is heated by the heat load. After heating in heat exchanger 15, the cryogen stream, in either gaseous or liquid state, is returned to storage vessel 11, wherein the returning warm cryogen stream melts a portion of the solid cryogen. During operation of the stored cryogenic refrigeration system when the system is charging by increasing the amount of the solid phase in storage vessel 11, a gas phase cryogen stream is withdrawn from storage vessel 11, compressed in compressor 17 and condensed to a liquid in condenser 19 by a coolant. The condensed liquid cryogen stream then passes through pressure regulator 34 and returns to the storage vessel 11. When carbon dioxide is used as the cryogen, the cryogen is preferably maintained at a temperature of about −70° F. and a pressure of about 75 psia in storage vessel 11.

The apparatus of the present invention for determining the mass fraction (F) of solid cryogen includes a liquid sample capillary 21 for extracting a very small part of the liquid cryogen from storage vessel 11. The liquid sample is transferred to a vaporizer coil 23 where the sample is heated to a temperature sufficient to vaporize the liquid sample and the trace substance contained in the liquid sample. A pressure regulator 25 and valve 27 are used to control the pressure and flow of gas to a sample analyzer 29. The sample analyzer 29 determines the amount of trace substance and the amount of cryogen in the sample. This analysis is fed to a computer 31 for determining the mass fraction of solid cryogen which is then displayed on monitor 33. The composition of the vapor sample is exactly the same as the composition of the original liquid sample withdrawn from the storage vessel 11. Various types of sample analyzers can be used in the apparatus of the present invention. Suitable detection techniques are gas chromatography, photo ionization and flame ionization or combinations of these detection techniques.

Storage vessel 11 operates at the triple point condition of the cryogen at the solid-liquid-gas interface in the storage vessel 11, where the three phases of solid, liquid and gas cryogen coexist in thermodynamic equilibrium. Due to the hydrostatic pressure head of the liquid phase cryogen in the storage vessel 11, the pressure of the liquid phase cryogen at the bottom of the storage vessel 11 is higher than the pressure of gas phase cryogen at the top of the storage vessel 11. It is preferable to extract the liquid phase sample from the bottom of the storage vessel 11 to utilize the pressure difference between the liquid phase cryogen at the bottom of the storage vessel 11 and the gas phase cryogen at the top of the storage vessel 11 to facilitate flow of the liquid sample through the liquid sample capillary 21.

Advisedly, the inside diameter and length of the liquid capillary 21 should be selected to limit the pressure drop between the entrance to the liquid capillary 21 and the entrance to the vaporizer coil 23 to be less than the pressure difference between the liquid phase cryogen at the bottom of the storage vessel 11 and the gas phase cryogen at the top of the storage vessel 11. This will prevent the formation of solid cryogen, with its potential flow blockage effect, in the liquid sample capillary 21 that could otherwise occur if the pressure of the liquid sample in the liquid sample capillary 21 dropped to a value less than the gas phase cryogen pressure in the storage vessel 11 while the temperature of the liquid sample remained at the triple point temperature of the cryogen.

In order to compute the mass fraction (F) of solid cryogen in the storage system based on the change in the mass concentration of a trace substance soluble in the liquid cryogen, the following symbols are defined:

M = total mass of cryogen in the storage system,

T = mass of trace substance in the storage system,

F = mass fraction of solid cryogen in the storage system,

S = mass of solid cryogen in the storage system, $C_I$ = initial mass concentration of the trace substance in the liquid phase cryogen of the storage system prior to the production of solid phase cryogen, and $C_N$ = new mass concentration of the trace substance in the liquid phase cryogen of the storage system after the production of a quantity of solid phase cryogen.

The initial mass concentration ($C_I$) of the trace substance in the liquid phase can be determined from either analyzing a sample of the liquid phase cryogen prior to the production of solid phase cryogen in the storage system or it can be determined from Equation (1):

$$C_I = T/M \quad (1)$$

After sufficient freezing to produce a mass (S) of solid cryogen in the storage system, the resulting new mass concentration ($C_I$) of trace substance in the liquid phase of the storage system may be determined from Equation 2:

$$C_N = T/(M-S) \quad (2)$$

Equations (1) and (2) can be combined to result in Equation (3):

$$S = M[1-(C_I/C_N)] \quad (3)$$

The mass fraction (F) of solid cryogen in the storage system may be determined from Equation (4):

$$F = S/M \quad (4)$$

Substituting Equation (3) into Equation (4) results in Equation (5):

$$F = 1-(C_I/C_N) \quad (5)$$

where F is the mass fraction of solid cryogen in the storage system. Equation (5) shows that the mass fraction (F) of solid cryogen in the storage system is a function of only the ratio of the initial mass concentration ($C_I$) of the trace substance in the liquid phase of the storage system to the new mass concentration ($C_N$) of the trace substance in the liquid phase of the storage system. $C_I$ is a constant in Equation (5), which can then be used to determine continuously the mass fraction (F) of solid cryogen in the storage system consisting of a mixture of liquid and solid cryogen.

The output signal from the sample analyzer 29 is a signal which represents $C_N$. A signal processor 31, such as a computer, can then be used to solve Equation (5) to obtain the mass fraction (F) of solid cryogen in the storage system. The resulting mass fraction (F) of solid cryogen in the storage system can then be continuously displayed on a solid fraction indicator 33.

What is claimed is:

1. A method for determining the mass fraction (F) of solid cryogen in a stored cryogenic refrigeration system containing a mass (S) of solid phase cryogen comprising:

adding mass (T) of a trace substance which is soluble in the liquid phase of said system;

determining the total mass (M) of the cryogen in said system;

determining the initial mass concentration ($C_I$) of the trace substance in said system by dividing (T) by (M);

extracting a liquid phase cryogen sample from said system;

heating said sample to a temperature sufficient to vaporize said sample;

analyzing said sample to determine the new mass concentration ($C_N$) of the trace substance in the sample which is dependent on the mass of solid cryogen which is present in said system;

dividing the initial mass concentration ($C_I$) by the new mass concentration ($C_N$) to provide a quotient; and subtracting said quotient from 1 to determine the mass fraction (F) of solid cryogen in said system.

2. A method according to claim 1 in which the cryogen is carbon dioxide stored at its triple point conditions of −70° F. and 75 psia.

3. A method according to claim 2 in which the trace substance is a hydrocarbon.

4. A method according to claim 3 in which the hydrocarbon is propane, propylene, normal butane, isobutane, butylene, normal pentane, isopentane, neopentane, cyclopentane or normal hexane.

5. A method according to claim 1 in which the initial mass concentration ($C_I$) of the trace substance is in the range from 10 to 1000 parts per million by weight.

6. An apparatus for determining the mass fraction (F) of solid cryogen in a stored cryogenic refrigeration system comprising:

means for storing solid phase cryogen and liquid phase cryogen in an insulated storage vessel;

means for extracting a sample of liquid phase cryogen from said storage vessel;

means for vaporizing said sample;

means for analyzing said vaporized sample to generate a signal representing the mass concentration ($C_N$) of a trace substance in said vaporized sample;

and means for processing said signal to determine the mass fraction (F) of solid cryogen in said system by solving the equation $$F = 1-(C_I/C_N)$$

wherein:

F = mass fraction solid cryogen in the storage system;

$C_I$ = initial concentration of the trace substance in the liquid phase cryogen sample prior to the production of solid phase cyrogen; and $C_N$ = mass concentration of the trace substance in the liquid phase cryogen sample after the production of solid phase cryogen.

7. An apparatus according to claim 6 in which the cryogen is carbon dioxide stored at its triple point conditions of −70° F. and 75 psia.

8. An apparatus according to claim 7 in which the trace substance is hydrocarbon.

9. An apparatus according to claim 8 in which the hydrocarbon is propane, propylene, normal butane, isobutane, butylene, normal pentane, isopentane, neopentane, cyclopentane or normal hexane.

10. An apparatus according to claim 8 in which the sample analyzer uses a flame ionization detector.

11. An apparatus according to claim 8 in which the sample analyzer uses a photo ionization detector.

12. An apparatus according to claim 6 in which the initial mass concentration ($C_I$) of the trace substance is in the range from 10 to 1000 parts per million by

13. An apparatus according to claim 6 in which the means for extracting the sample of liquid phase cryogen is located in the bottom of the storage vessel.

14. An apparatus according to claim 13 in which the means for extracting the sample of liquid phase cryogen from the bottom of the storage vessel involves the use of a liquid sample capillary whose inside diameter and length are selected to limit the pressure drop between the entrance to the liquid sample capillary and the entrance to the means for vaporizing the liquid sample to be less than the hydrostatic pressure of liquid phase cryogen in the storage vessel.

* * * * *